US011002024B2

(12) United States Patent
Salviola, III

(10) Patent No.: US 11,002,024 B2
(45) **Date of Patent: *May 11, 2021**

(54) STORAGE CONTAINER

(71) Applicant: Rocco Salviola, III, Burr Ridge, IL (US)

(72) Inventor: Rocco Salviola, III, Burr Ridge, IL (US)

(73) Assignee: Rocco Salviola, Burr Ridge, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/930,068

(22) Filed: May 12, 2020

(65) Prior Publication Data

US 2020/0270878 A1 Aug. 27, 2020

Related U.S. Application Data

(63) Continuation of application No. 16/210,543, filed on Dec. 5, 2018, now Pat. No. 10,683,669.

(60) Provisional application No. 62/594,924, filed on Dec. 5, 2017.

(51) Int. Cl.

| | |
|---|---|
| ***E04F 19/08*** | (2006.01) |
| ***B65D 43/24*** | (2006.01) |
| ***B65D 43/22*** | (2006.01) |
| ***A47B 81/00*** | (2006.01) |

(52) U.S. Cl.

CPC ..... *E04F 19/086* (2013.01); *A47B 81/002* (2013.01); *B65D 43/22* (2013.01); *B65D 43/24* (2013.01); *A47B 81/00* (2013.01); *B65D 2251/1008* (2013.01); *B65D 2251/1016* (2013.01)

(58) Field of Classification Search

CPC ..... E04F 19/086; B65D 43/22; B65D 43/24; B65D 2251/008; B65D 2251/1016; A47B 81/00; A47B 81/002

See application file for complete search history.

(56) References Cited

U.S. PATENT DOCUMENTS

| | | | | |
|---|---|---|---|---|
| 2,256,928 A | | 9/1941 | Slack et al. | |
| 2,766,856 A | * | 10/1956 | Nelsson | E04F 19/08 49/246 |
| 3,131,512 A | * | 5/1964 | MacLeod, Jr. | H02G 3/185 52/220.5 |
| 3,326,410 A | | 6/1967 | Asenbauer | |

(Continued)

FOREIGN PATENT DOCUMENTS

| | | | |
|---|---|---|---|
| CA | 2203336 | A1 | 10/1998 |
| CN | 102582950 | A | 7/2012 |

OTHER PUBLICATIONS

International Application No. PCT/US18/63969, International Search Report and Written Opinion, dated Feb. 19, 2019.

*Primary Examiner* — Daniel J Rohrhoff

(74) *Attorney, Agent, or Firm* — Marshall, Gerstein & Borun LLP

(57) ABSTRACT

A container is described herein that is configured to be mounted between joists in a substrate of a structure, such as a floor, wall, or ceiling. The container includes a body portion sized to be disposed between the joists and a lid to cover an opening to the body. The lid can further be configured to be coplanar with a covering material of the substrate so that the container does not project outwardly from the substrate.

11 Claims, 5 Drawing Sheets

(56) References Cited

U.S. PATENT DOCUMENTS

| | | | | |
|---|---|---|---|---|
| 3,331,645 | A * | 7/1967 | Vercellotti | A47B 49/002 312/248 |
| 4,738,054 | A | 4/1988 | Muth et al. | |
| 6,088,239 | A | 7/2000 | Zeiss | |
| 6,802,577 | B2 * | 10/2004 | Gershfeld | A47B 21/0073 108/50.01 |
| 7,578,243 | B2 * | 8/2009 | Gevaert | A47B 21/0073 108/25 |
| 7,963,621 | B1 * | 6/2011 | Ellis | B25H 3/04 312/242 |
| 9,737,144 | B1 * | 8/2017 | Brown | B65D 81/00 |
| 10,683,669 | B2 * | 6/2020 | Salviola, III | A47B 81/002 |
| 2004/0150301 | A1 * | 8/2004 | Liberman | A47B 81/002 312/245 |
| 2008/0036341 | A1 | 2/2008 | Nilsen et al. | |
| 2008/0315737 | A1 * | 12/2008 | Hammond | B25H 3/023 312/242 |
| 2009/0015121 | A1 * | 1/2009 | Sampson | A47B 67/02 312/242 |
| 2014/0053472 | A1 * | 2/2014 | DeLorean | A47B 51/00 52/29 |

* cited by examiner

STORAGE CONTAINER

CROSS-REFERENCE TO RELATED APPLICATIONS

This application is a continuation of U.S. application Ser. No. 16/210,543, filed Dec. 5, 2018, which claims the benefit of U.S. Provisional Application No. 62/594,924, filed Dec. 5, 2017, which are both hereby incorporated by reference herein in their entireties.

FIELD OF THE DISCLOSURE

The present disclosure is directed to containers and, more particularly, to lidded containers.

BACKGROUND

In many structures, storage space can be limited. Some systems and containers are available to provide organized storage in conventional storage locations, such as closets, garages, and so forth. Such systems and containers, however, may be configured to rest on a floor or mount to a wall or ceiling, which takes up space within the storage locations and does not utilize the space within such substrates.

SUMMARY

A container is described herein that utilizes such available space by being configured to be mounted between joists in a substrate of a building. The container includes a body having at least one wall portion that defines an interior. The at least one wall portion includes an edge defining an opening to the interior. The container further includes flanges that project outwardly from opposite sides of the body that are configured to abut the joists with the body in an installed position between the joists. The container further includes a lid that is pivotably coupled to the body to selectively cover the opening.

In some embodiments, the container can further include a magnetic coupling having one or more components coupled to the body and/or lid to thereby releasably hold the lid in a closed position.

In some embodiments, the body of the container can be box-shaped and the at least one wall portion includes end wall portions, side wall portions extending between the end wall portions, and a bottom wall portion opposite the opening. In further embodiments, the flanges extend along the edges of the side wall portions. In yet further embodiments, the container can include transverse flanges that extend along corners between the end walls and side walls to abut the joists.

In some embodiments, the container can include a hydraulic lift support mechanism coupled to the body and the lid that is configured to aid in lifting the lid.

In some embodiments, the substrate can include a covering material extending over the joists and an outer surface of the lid can be coplanar with an outer surface of the covering material. In further embodiments, the covering material can be a floor that includes a sub-floor and a finished floor. The lid can then include an outer layer that is the same material as the finished floor.

In some embodiments, the body can include two chambers where each chamber is configured to be positioned between joists in the substrate. As such, the body can include a bridge portion that extends between the chambers and is configured to extend over a joist between the chambers.

BRIEF DESCRIPTION OF THE DRAWINGS

The above needs are at least partially met through provision of the container embodiments described in the following detailed description, particularly when studied in conjunction with the drawings, wherein.

Figure 1:
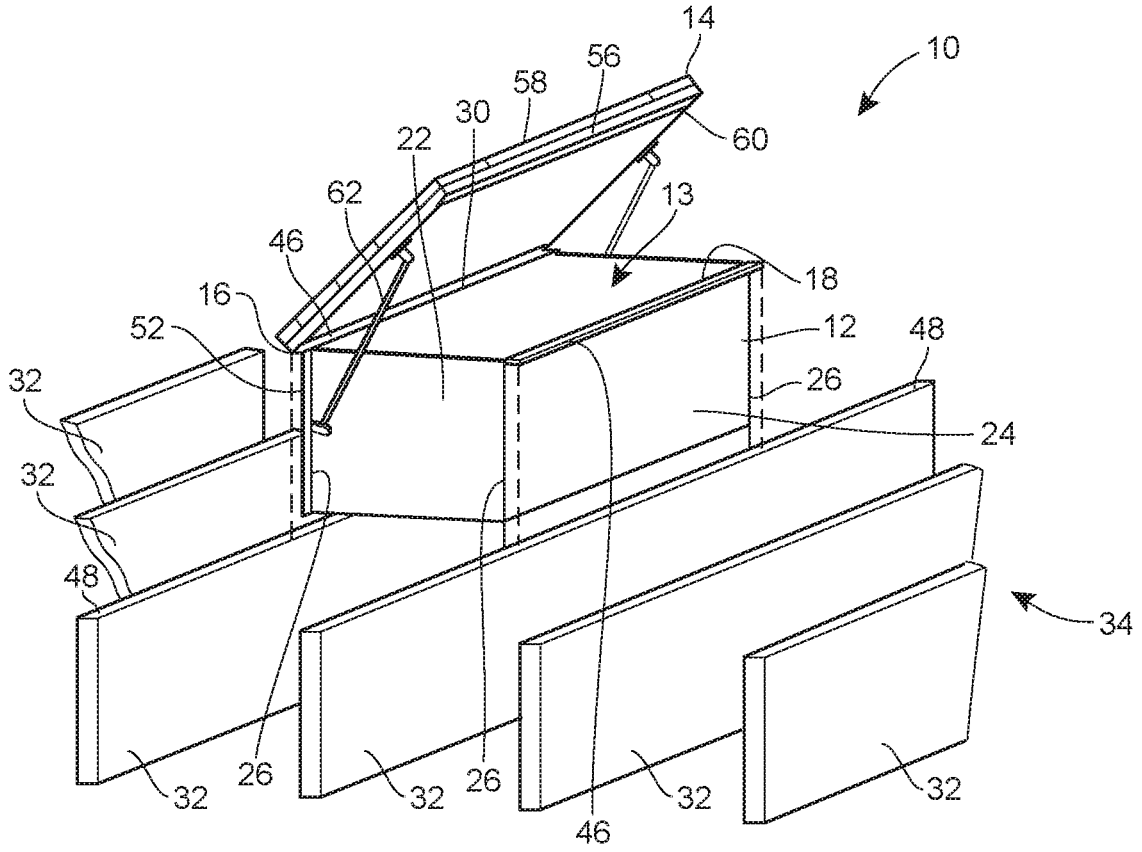
FIG. 1 is a perspective view of a first embodiment of a container configured to be mounted between joists in a substrate of a structure in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

A container is described herein that is configured to be mounted between joists in a substrate of a structure, such as a floor, wall, or ceiling. A container having such a configuration advantageously utilizes space for storage that would otherwise be unusable. The container can further be configured to be coplanar with a covering material of the substrate so that the container does not project outwardly from the substrate. By utilizing a matching material for an outer layer of a lid for the substrate, the container can be effectively concealed.

Details of one embodiment of such a container 10 are shown in FIGS. 1-5. As shown, the container 10 includes a body 12 defining an interior chamber 13 and a lid 14 that is pivotably coupled to the body 12 by a hinge or hinges 16.

The lid 14 is configured to be pivoted between open and closed positions exposing and covering an opening 18 to the interior 13 of the body 12.

In the illustrated form, the body 12 is generally box-shaped having a frame including end walls 22, side walls 24 extending between the end walls 22 and joined by corners 26, and a bottom wall or platform 28. The opening 18 is opposite the bottom wall 28 and defined by top edges 30 of the end and side walls 22, 24. The end walls 22, side walls 24, and bottom wall 28 can be connected or secured together using any suitable method, such as fasteners, welding, one or more pieces of material bent as desired, and so forth.

The body 12, and specifically, the end walls 22 thereof are preferably sized to extend between joists 32 in a substrate 34 of a structure, so that the container 10 can be mounted therebetween. Further, the end and side walls 22, 24 can have a depth corresponding to a width of the joists 32, such as generally equal to or less then the width thereof.

The substrate 34 can be a floor as shown in the figures, a wall, or a ceiling of the structure. Further, the substrate 34 can include a covering material 36 mounted or coupled to the joists 32 to extend thereover. The covering material 36 may further include one or more layers. For example, if the substrate 34 is a floor, the covering material 36 can include a subfloor layer 38 and a finished layer 40. If the substrate 34 is a wall or ceiling, the covering material 36 can be drywall, plaster configured with slats and/or mesh as commonly understood, and so forth. As shown in the figures, the substrate 34 can include an opening 42 extending through the covering material 36 to expose an area 44 between two adjacent joists 32. The opening 42 can preferably have width and length dimensions generally equal to or slightly larger than the body 12, specifically and the end and side walls 22, 24 thereof, so that the container 10 fits snugly within the opening 42.

The container 10 can further include lateral flanges 46 that project outwardly from the top edges 30 of the side walls 24 in a direction generally parallel with the covering material 36. The flanges 46 are configured to project over and abut outward surfaces 48 of the joists 32 or the covering material 36. If the substrate 34 is a floor, the flanges 46 prevent the container 10 from falling between the joists 32 and hold the body opening 18 adjacent to the covering material 36. Where the substrate 34 is a wall or ceiling, the flanges 46 aid in mounting the container 10 by abutting the joists 32. Further, if desired, a user can mount the container to the joists 32 through the flanges 46 using fasteners 50.

The container 10 can further include one or more transverse flanges 52 that project outwardly from some or all of the corners 26 of the body 12 to extend along a portion of the width of the joists 32. One or more fasteners 54 can then be inserted through the transverse flanges 52 to thereby secure the container 10 to the joists 32. The flanges 46, 52 enable a user to secure the container 10 to the joists 32 without puncturing the end or side walls 22, 24 corresponding to the body interior 13. The flanges 46, 52 can be portions of the end walls 22, the side walls 24, or can be secured thereto by welding, fasteners, or the like.

Figure 2:
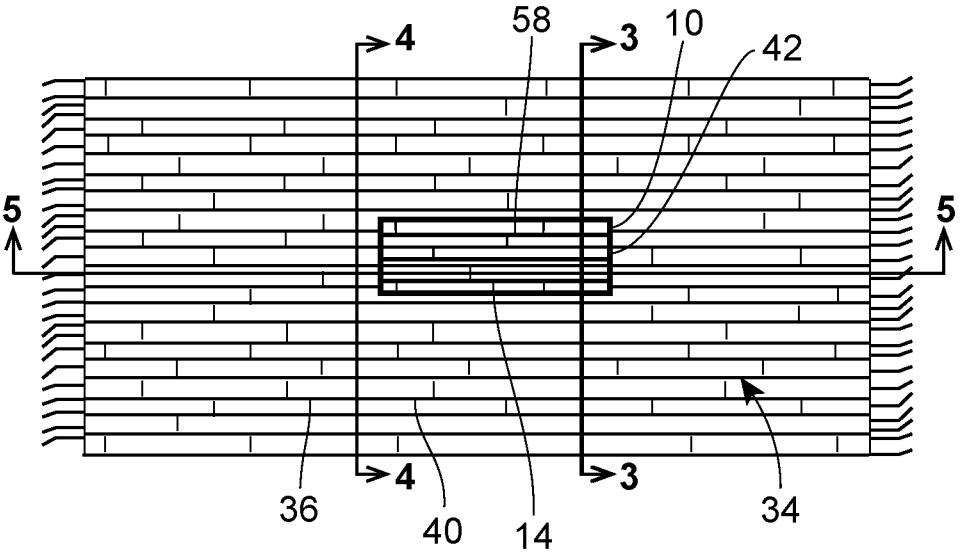
FIG. 2 is a top plan view of the container of FIG. 1 installed in a substrate of a structure showing a lid thereof in a closed position in accordance with various embodiments.
Figure 3:
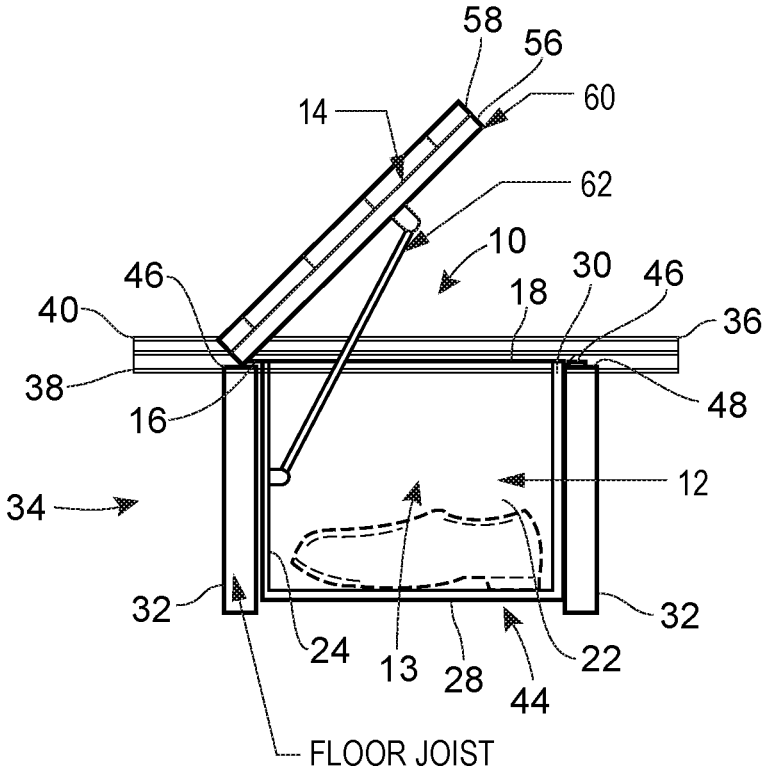
FIG. 3 is a side cross-sectional view of the container taken along the line 3-3 in FIG. 2 in accordance with various embodiments.
Figure 4:
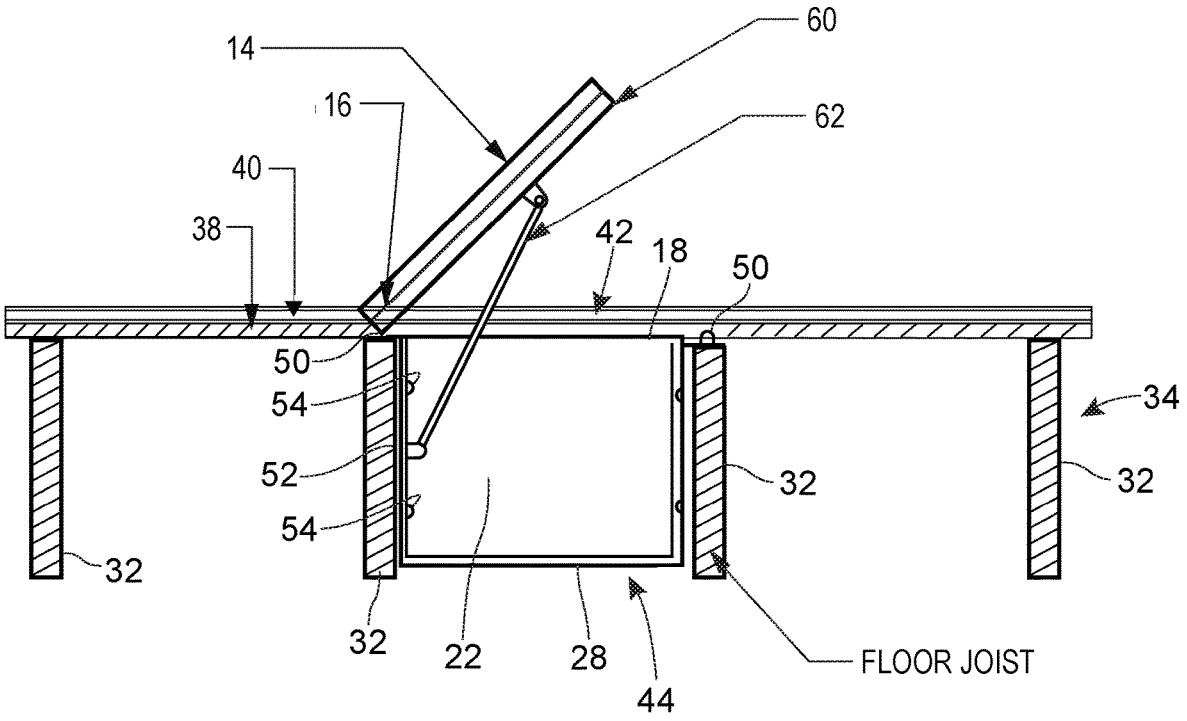
FIG. 4 is a side cross-sectional view of the container taken along the line 4-4 in FIG. 2 in accordance with various embodiments.
Figure 5:
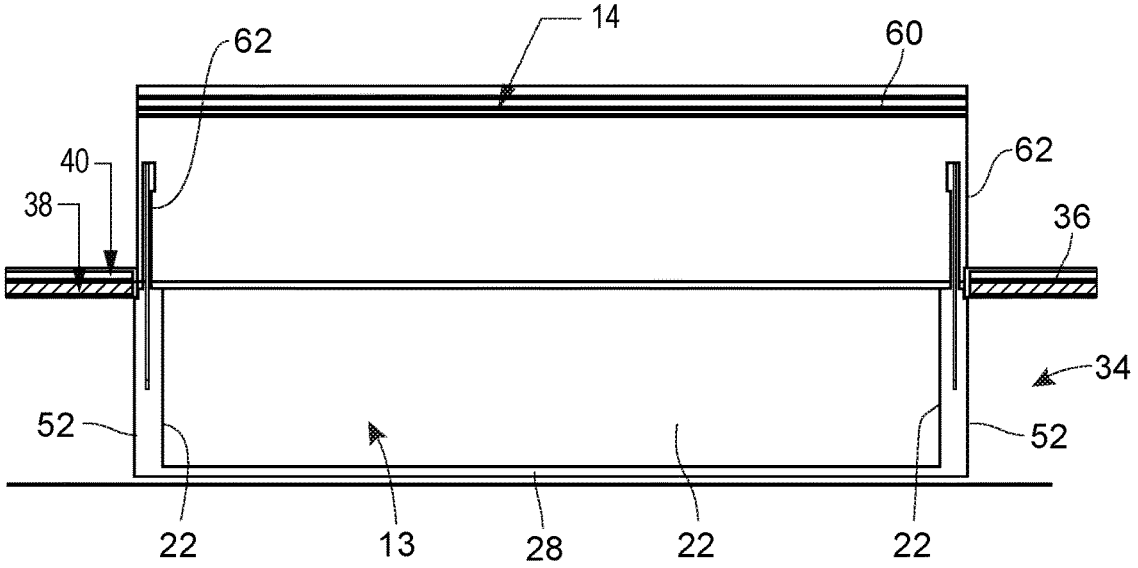
FIG. 5 is a front cross-sectional view of the container taken along the line 5-5 in FIG. 1 in accordance with various embodiments.

As set forth above, the lid 14 is pivotably coupled to the body 12 via one or more hinges 16. In the illustrated form, the hinges 16 are concealed from view. For example, the hinges 16 can be disposed between the body 12 and lid 14 and/or disposed in a recessed position adjacent to the flanges 46 or side wall 24. So configured, the hinges 16 are hidden from view when the container 10 is installed between the joists 32 as shown in FIG. 2.

In the illustrated form, the lid 14 includes a lower layer 56 of a rigid material to cover the body opening 18 and an upper layer 58 that can be utilized as a decorative layer, such as to be the same material or match the finished layer 40 of the covering material 36. Preferably, the lower layer 56 and upper layer 58 have a depth combined that is generally equal to the covering material 36 so that an upper surface of the container 10 is coplanar with the covering material 36.

To hold the lid 14 in the closed position, the container 10 can include a closure member or mechanism 60 to releasably hold the lid 14 in the closed position. By one approach, the closure mechanism 60 can be one or more magnetic members 60 coupled to one of the body 12 or lid 14 with the other having aligned metal portions configured to magnetically attach to the magnetic members 60. In the illustrated form, the magnetic member 60 is a strip that aligns with the flange 46 opposite the hinge 16. If desired, the magnetic member 60 can also include a push mechanism that is configured to be depressed to pop-out from a first, closed position to a second, raised position to thereby make the lid 14 easier to grab by a user. Of course, other suitable closure members can be utilized, such as hook-and-loop fasteners, snap fit structure, or other cooperating members.

With some materials and configurations, the lid 14 may be heavy to lift for a user. In such cases, or to ease use, the container 10 can include one or more hydraulic gas strut lifts 62 coupled to the lid 14. In the illustrated form, the lifts 62 are further coupled to the transverse flanges 52 to thereby extend along an exterior surface 64 of the end walls 22 and provide a ready-to-install container 10.

Figure 6:
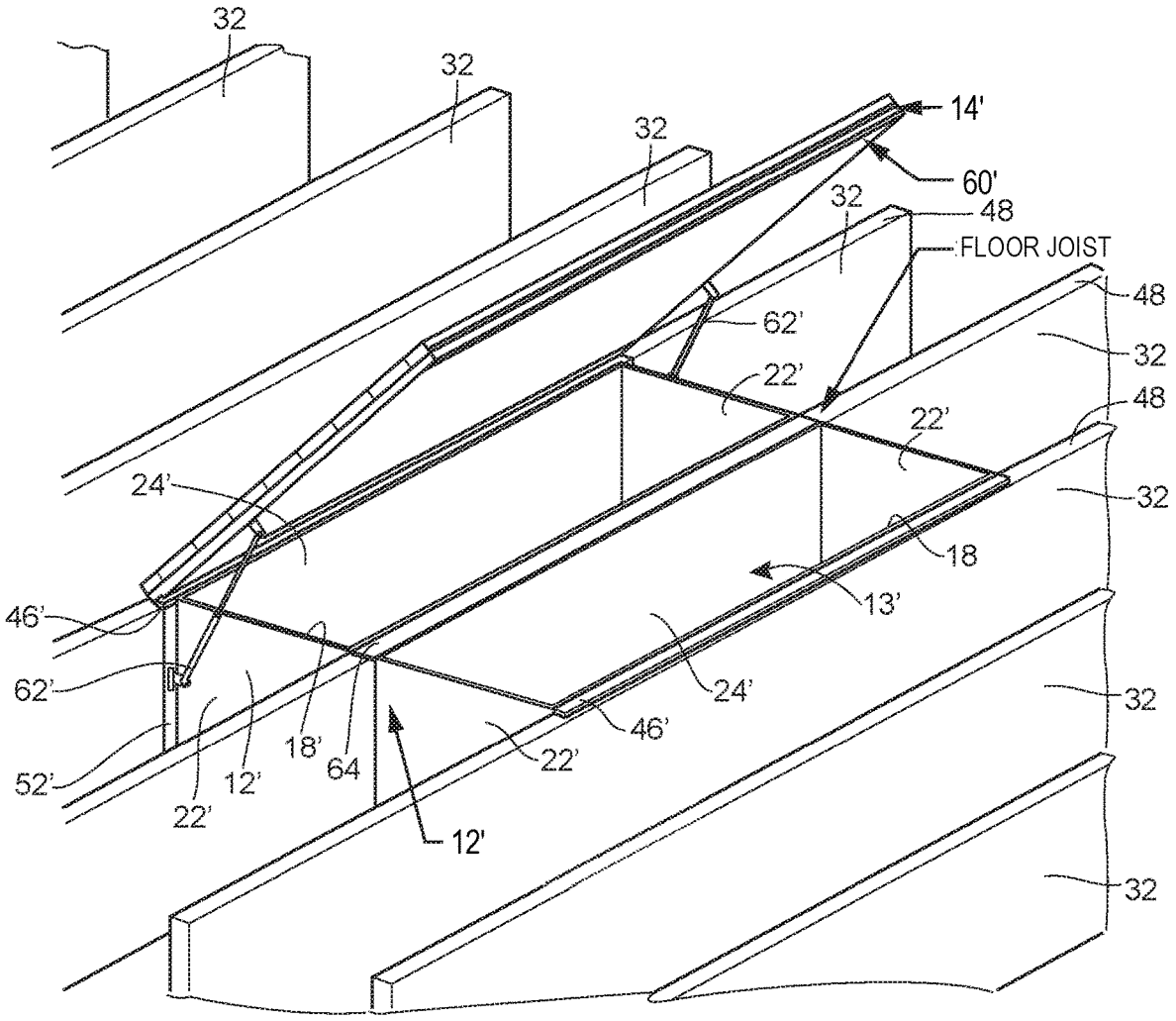
FIG. 6 is a perspective view of a second embodiment of a container configured to be mounted between adjacent joists in a substrate of a structure in accordance with various embodiments.
Figure 7:
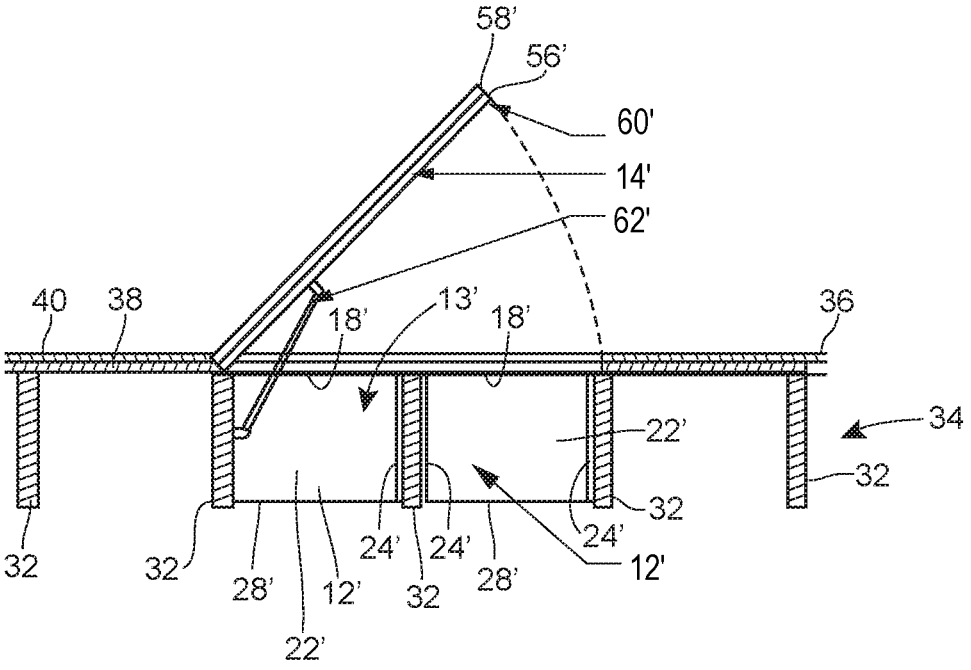
FIG. 7 is a side elevational view of the container of FIG. 6 in accordance with various embodiments.

While the container 10 has been described with a one chamber interior 13, as shown in FIGS. 6 and 7, a container 10' can be expanded to include multiple chambers, each configured to be disposed between adjacent joists 32. In this embodiment, the container 10 includes two body portions 12' that, when installed, are disposed on either side of a central joist 32. The two body portions 12' are coupled together by a bridge portion 64 that is configured to extend over the central joist 32. Each body portion 12' includes corresponding end walls 22', side walls 24', and bottom walls 26'. As shown, the lid 14' of this form is sized to extend over and cover the openings 18' to both body portions 12'. Components configured as described above with regard to the container 10 are labeled in the figures with like reference characters. Additional embodiments can include more body portions 12' as desired.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A container configured to be mounted within an opening in a substrate of a building, the container comprising:

a body including at least one wall portion defining an interior, the at least one wall portion having an edge defining an open top providing access to the interior;

flanges projecting outwardly from opposite sides of the body, the flanges configured to abut portions of the substrate with the body in an installed position within the substrate;

a lid pivotably coupled to the body to engage the edge of the at least one wall portion and the flanges to cover the open top of the body in a closed position, the lid sized to extend to an edge of the opening in the substrate around a perimeter thereof and configured such that with the body in the installed position within the substrate and the lid in the closed position, an outer surface of the lid is substantially coplanar with an outer surface of the substrate.

2. The container of claim 1, further comprising a magnetic coupling having one or more components coupled to at least one of the body or the lid to thereby releasably hold the lid in the closed position.

3. The container of claim 1, wherein the body is box-shaped, the at least one wall portion including end wall portions, side wall portions extending between the end wall portions, and a bottom wall portion opposite the opening.

4. The container of claim 3, wherein the flanges extend along the edges of the side wall portions.

5. The container of claim 4, further comprising transverse flanges extending along corners between the end walls and side walls to abut the substrate.

6. The container of claim 1, further comprising a hydraulic lift support mechanism coupled to the body and the lid and configured to aid in lifting the lid.

7. The container of claim 1, wherein the flanges are configured to abut joists in the substrate with the body in an installed position between the joists.

8. The container of claim 7, wherein the substrate includes a covering material extending over the joists and the outer surface of the lid is configured to be coplanar with an outer surface of the covering material with the lid in the closed position.

9. The container of claim 8, wherein the covering material comprises a floor, the floor including a sub-floor and a finished floor.

10. The container of claim 9, wherein the lid includes an outer layer, the outer layer comprising a same material as the finished floor.

11. The container of claim 7, wherein the body includes two chambers, each chamber configured to be positioned between joists in the substrate, the body including a bridge portion extending between the chambers configured to extend over a joist between the chambers.

* * * * *